US007717074B2

(12) United States Patent
Kleiber et al.

(10) Patent No.: US 7,717,074 B2
(45) Date of Patent: May 18, 2010

(54) CAMSHAFT ADJUSTER FOR AN INTERNAL COMBUSTION ENGINE

(75) Inventors: Thomas Kleiber, Wahlschied (DE); Rainer Ottersbach, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 373 days.

(21) Appl. No.: 11/722,143

(22) PCT Filed: Nov. 11, 2005

(86) PCT No.: PCT/EP2005/012097

§ 371 (c)(1),
(2), (4) Date: Jun. 19, 2007

(87) PCT Pub. No.: WO2006/074737

PCT Pub. Date: Jul. 20, 2006

(65) Prior Publication Data

US 2009/0090321 A1 Apr. 9, 2009

(30) Foreign Application Priority Data

Dec. 23, 2004 (DE) ..... 10 2004 062 071

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,098,346 | A * | 3/1992 | Redmond | 474/161 |
| 5,836,278 | A * | 11/1998 | Scheidt | 123/90.17 |
| 5,934,447 | A * | 8/1999 | Kanaris | 198/834 |
| 6,412,462 | B1 | 7/2002 | Lichti et al. | |
| 6,651,600 | B1 * | 11/2003 | Schafer et al. | 123/90.17 |

FOREIGN PATENT DOCUMENTS

| | | |
|---|---|---|
| DE | 19951390 | 5/2001 |
| DE | 10109837 | 9/2002 |
| DE | 10211607 | 10/2003 |
| DE | 10335051 | 7/2004 |
| JP | 2002138806 | 5/2002 |

* cited by examiner

*Primary Examiner*—Zelalem Eshete
(74) *Attorney, Agent, or Firm*—Volpe and Koenig, P.C.

(57) ABSTRACT

A camshaft adjuster (1) for an internal combustion engine is provided, wherein the relative angle between a drive wheel (2) and an inner rotor associated with a camshaft can be adjusted via hydraulic loading of pressure spaces (9, 10) between an outer rotor (3) and the inner rotor (6), wherein the drive wheel (2) is made of plastic and the outer rotor (3) associated with the drive wheel (2) is made of metal. Particularly good linkage can be obtained and mounting complexity can be reduced by having at least one bearing surface between the outer rotor (3) and the inner rotor (6) that is connected with a firmly bonded material or positive fit in the drive wheel that is made from plastic.

10 Claims, 3 Drawing Sheets

CAMSHAFT ADJUSTER FOR AN INTERNAL COMBUSTION ENGINE

BACKGROUND

The invention relates to a camshaft adjuster for an internal combustion engine according to the preamble of Claim 1.

From DE 102 11 607 A1, a camshaft adjuster for adjusting and fixing the relative rotational angle position of a camshaft relative to the crankshaft of an internal combustion engine is known. A hydraulic adjustment device here consists of an external rotor, which is allocated to a drive wheel, and also an internal rotor, which is connected to a camshaft via a driven element. Pressure chambers are formed between the external rotor and the internal rotor. Charging these chambers hydraulically can change the angular relationship between the drive wheel and driven element.

In the mentioned publication, it is proposed to produce the drive wheel and at least one of the other functional parts integrally from a high load capacity plastic. According to a first embodiment, the drive wheel and the external rotor and also two other components are produced integrally from plastic. For an alternative construction, the external rotor is produced as a separate component from plastic or from a conventional material, such as metal, and is set in a cover formed integrally

SUMMARY

The invention is based on the objective of creating a camshaft adjuster, which is functionally ready or optimized for good production possibilities, a small number of required components, and low weight.

According to the invention, the objective is met by the features of the independent Claim 1.

The invention is based on the knowledge that for the embodiment of DE 102 11 607 A1 named above, a bearing surface is formed with plastic, which is not optimum, under some circumstances, both for a contact partner made from metal and also for such an element made from plastic in terms of bearing properties, sliding properties, and wear as well as operational strength. For example, if a plastic in the form of a duroplastic is used for an external rotor, then it has been shown that such duroplastics can contain minerals. These minerals lead to increased wear and increased friction on sliding surfaces, also those made from steel, and in the worst case to failure of the camshaft adjuster. On the other hand, it has been shown for the second embodiment named above from DE 102 11 607 A1 that a use of a metallic bearing surface requires an additional mounting step, in some circumstances unnecessarily, in a surrounding plastic body. Furthermore, through such a placement, under some circumstances another degree of freedom or play and production inaccuracy for the bearing surface is produced, which can negatively affect the operation of the camshaft adjuster.

Therefore, according to the invention the bearing surface of the external rotor is formed with a metallic insert body, which is held with a firmly bonded material fit in a carrier body made from plastic. Through this firmly bonded material hold, the undesired degrees of freedom, play, and unnecessary mounting steps can be avoided. Nevertheless, according to the invention a metallic insert body can be used, so that a metallic bearing surface is given, whereby the increased wear and increased friction on the sliding surfaces can be avoided. The carrier body according to the invention can involve either the drive wheel itself or another component, such as a flange, which is connected to the drive wheel via corresponding attachment elements with a friction, positive, and/or firmly bonded material fit, possibly through the intermediate connection of additional components.

According to one improvement of the invention, the insert body is constructed extending in the peripheral direction and also forms a limit for the pressure spaces in addition to the bearing surface. Accordingly, the insert body has a multifunction construction with the function of the bearing and the operating-fixed shape of the pressure spaces. Here, the insert body can limit the pressure spaces radially outwardly and/or in the peripheral direction and, under some circumstances, can form limits or stops for the internal rotor. Through the formation of the insert body extending in the peripheral direction, a rigid, closed ring structure is formed. In addition, the insert body thus correlates the position and orientation of several pressure spaces distributed over the periphery.

For improving the positive-fit connection between the external rotor and the carrier body, at least one of the previously mentioned components can have connection elements. Such connection elements can involve ribs, radial projections, or radial recesses, in which a connection means, such as an adhesive, molten material, or injection molded parts of one of the previously mentioned components can be inserted or supported. In this way, the surface of the contact points between the non-positive connection means and the external rotor and carrier body can be increased. Simultaneously, a force to be transmitted between the external rotor and carrier body is supported due to the connection elements by means of larger surfaces. The transmitted forces can be transmitted by the connection elements for suitable shaping between shearing forces in the area of a casing surface and also normal forces through the radial projections and also recesses.

In one preferred camshaft adjuster according to the invention, the drive wheel is produced from a composite material or a fiber composite material. Examples here can be thermoplastics or duroplastics or materials made from thermoplastics and duroplastics together. In this way, according to the material selection and material combination, the mechanical properties of the drive wheel can be influenced in a suitable way.

According to another aspect of the invention, the internal rotor is (also) formed with plastic. The internal rotor has at least one bearing surface made from metal connected to this rotor with a firmly bonded material fit. Accordingly, advantages known for a construction made from plastic and named, for example, in DE 102 11 607 A1 can be used for the rotor. In addition, both the internal rotor and also the external rotor have bearing surfaces made from metal, which has proven advantageous in terms of sliding properties and operating strength.

According to an improvement of the invention, the drive wheel is formed with a belt wheel or a chain wheel from plastic and connected by means of attachment elements to the carrier body formed as a flange made from plastic, which is attached, in turn, to the insert body with a positive fit. Accordingly, a production of the drive wheel, which requires, for example, a formation of teeth with complex teeth structures is allowed separate from a production of the flange with insert bodies, wherein the same or different production methods and the same or different material can be used according to requirements. An operating-fixed connection can be created equally, however, by means of the attachment elements between the drive wheel and flange and also the positive fit or firmly bonded material connection between the flange and insert body.

For the case that the attachment elements are not to interact with the material of the drive wheel or the flange otherwise used, it is advantageous when the attachment elements interact with reinforcement inserts of the drive wheel and/or the flange. Such reinforcement inserts can involve, for example, metal intermediate layers such as inserts, which are supported, for example, with their casing surface opposite the other material of the drive wheel or the flange while guaranteeing a good force introduction. Possible receptacle recesses of the reinforcement inserts can be shaped selectively for connecting to the attachment elements. For example, they can be inserted into the threading, with which the attachment elements are screwed. In this way, an especially compact construction of the camshaft adjuster is allowed for simultaneously good force introduction and transmission.

According to another construction of the invention, the connection between the flange and chain wheel or belt wheel is realized radially inwardly from the teeth of the chain wheel or belt wheel. Here, the axial dimension of the chain or belt wheel or its teeth is dependent and given by the force to be transmitted from the drive means, such as a chain or a belt, whereby a minimum of the axial installation length of the camshaft adjuster is given. The installation space can be used optimally according to the invention, because the already present inner space of a chain or belt wheel is used for an arrangement of the connection point between the flange and chain wheel. Here, for example, the chain or belt wheel can have a radially inwardly directed connecting piece, which is screwed to the flange. Another advantage according to the invention is that forces transmitted by the drive means, like the belts, to the drive wheel are not transmitted with a large tilting moment on the internal rotor and additional components of the camshaft adjuster. An optimal solution is produced when the connecting piece, the flange, or the connection point between these is arranged approximately in the axial direction approximately centrally in the drive wheel.

An even more compact construction of the camshaft adjuster according to the invention is produced when the attachment elements act on a radius that is less than an outer diameter of the pressure chamber. Here, on one hand a radial installation size of the camshaft adjuster can be reduced, because unnecessary, unused installation spaces are avoided, especially between the pressure chamber and belt wheel. On the other hand, for a given size of the drive wheel, the outer diameter of the pressure chamber can be increased, which, under some circumstances, has the result of improved actuation while changing the hydraulic effect.

For a further improved camshaft adjuster, insert bodies and carrier bodies are connected to each other with a firmly bonded material fit by means of an injection molding process. Accordingly, the insert bodies can be used in addition to their functions in operation during the production as shaping surfaces for an injection molding process, in that injection molding is performed on this material. The injection molding process simultaneously guarantees an especially good positive-fit connection between the contact body and carrier body.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

Figure 1:
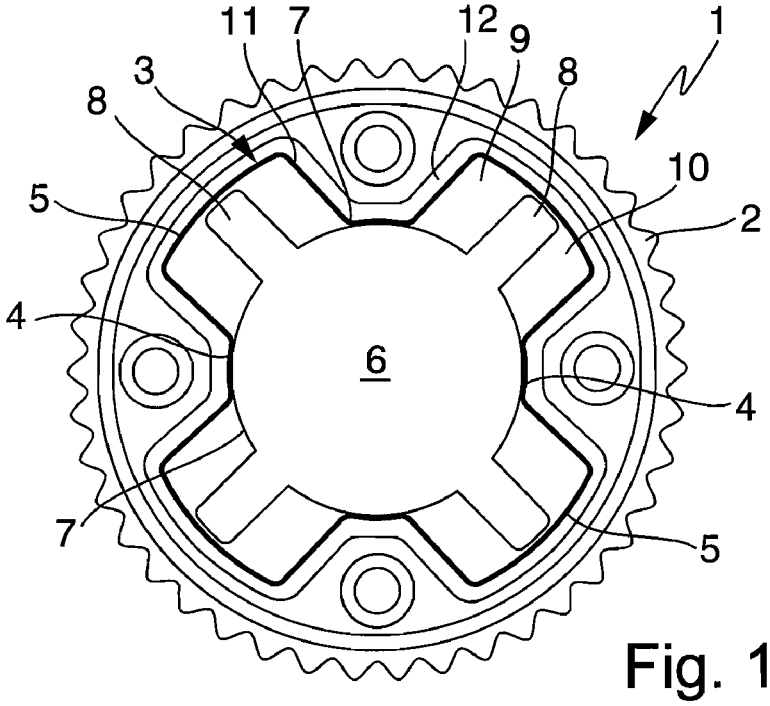
FIG. 1 a cross-sectional view of a part of a camshaft adjuster according to the invention with an external rotor and a carrier body made from plastic with an insert body attached with a firmly bonded material fit and also an internal rotor that can rotate in the external rotor.

The invention relates to a hydraulic camshaft adjuster 1 in a known construction. The camshaft adjuster has a drive wheel 2, which is constructed in the shown embodiments as a belt wheel. An external rotor 3, which is arranged radially inside of the drive wheel 2, is connected rigidly to the drive wheel 2. The external rotor 3 is formed with bearing surfaces 4, which correspond to segments of a casing surface of a cylinder, as well as radial bulges for pressure chambers 5. According to the embodiment shown in FIG. 1, four bearing surfaces 4 and also four pressure chambers 5 are provided, which are distributed equally over the periphery. In the external rotor 3, an internal rotor 6, which can be connected or is connected locked in rotation with the camshaft, is arranged so that it can rotate relative to the external rotor about a longitudinal axis of the camshaft adjuster 1. The internal rotor 6 has bearing surfaces 7 formed corresponding to the bearing surfaces 4 of the external rotor 3 and also vane-like radial projections 8, wherein four bearing surfaces 7 and four projections 8, which are distributed arbitrarily or equally over the periphery of the internal rotor, are provided according to the embodiment shown in FIG. 1. The bearing surfaces 4 and 7 form a seal in the peripheral direction and the end surfaces of the projections 8 extend radially outwardly forming a seal on the associated pressure chambers 5, so that pressure spaces 9, 10 are formed in the peripheral direction on both sides of the projections. Through suitable charging of the pressure chambers 9, 10, the relative angular position between the external rotor 3 and the internal rotor 6 can be changed, whereby the angular relationship between the drive wheel 2 and a camshaft can be changed for adjusting the opening times of valves.

According to FIG. 1, both the pressure chambers 5 and also the bearing surfaces 4 are formed with a metallic insert body 11 extending in the peripheral direction, which has an approximately constant wall thickness. The insert body 11 is held with a firmly bonded material fit in a carrier body 12, which is formed in the embodiment shown in FIG. 1 integrated with the drive wheel 2 or is formed as a separate component, which can be connected rigidly to the drive wheel 2.

Figure 2:
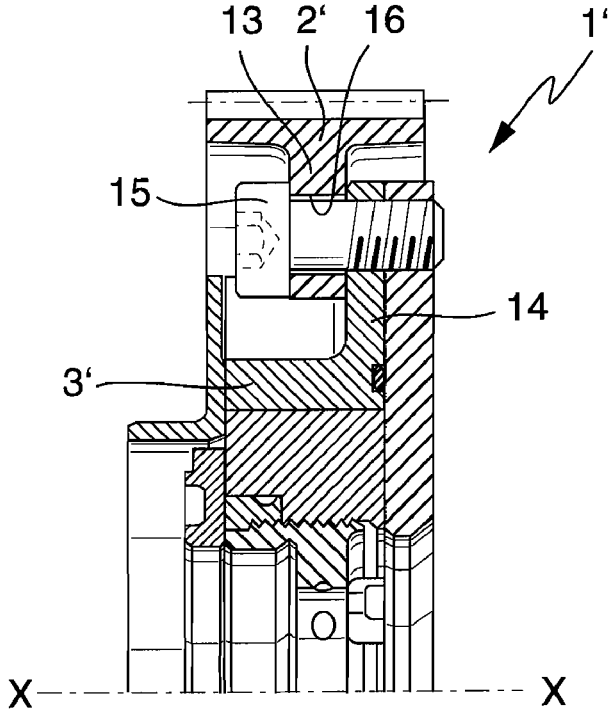
FIG. 2 half of a longitudinal cross-sectional view of a camshaft adjuster according to the invention in which the drive wheel made from plastic is attached to a flange by means of an attachment element.
Figure 3:
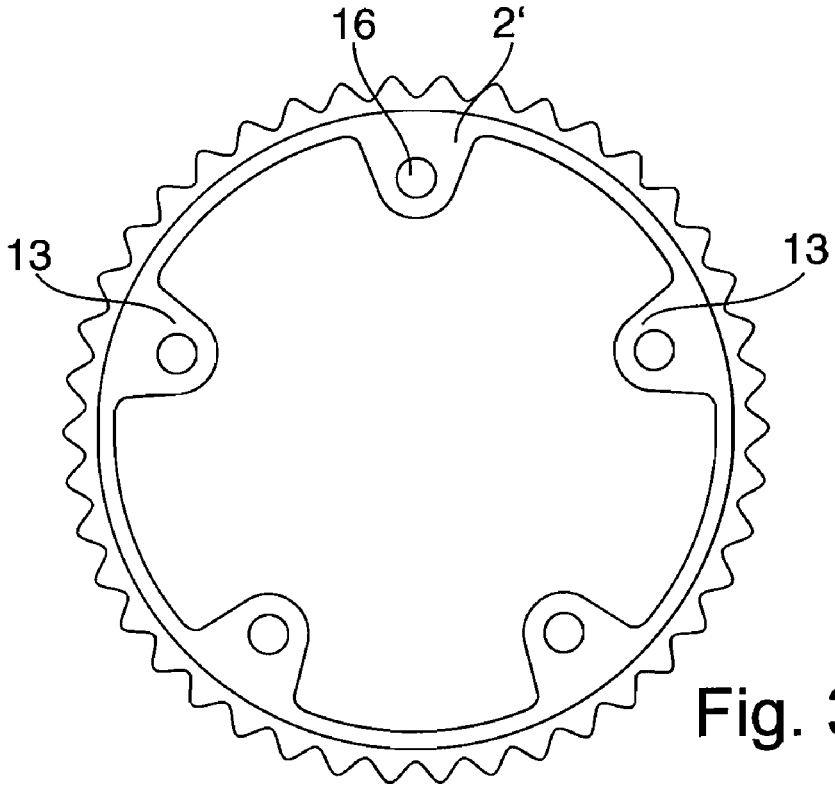
FIG. 3 a view of a drive gearwheel made from plastic according to the invention with radially inwardly pointing brackets for receiving attachment elements.
Figure 4:
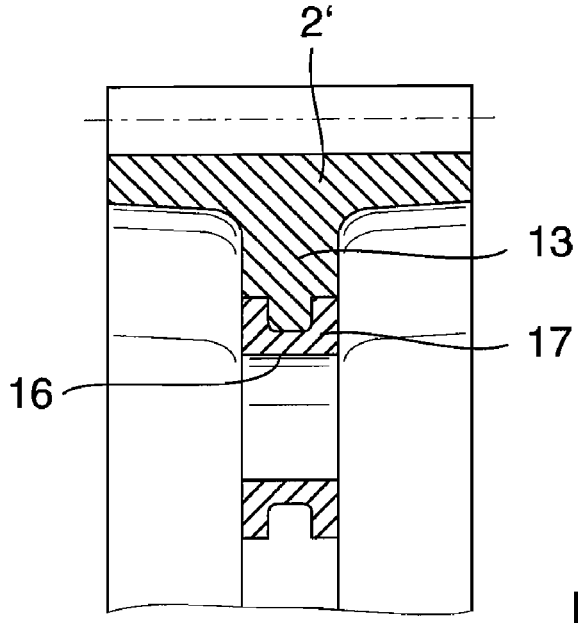
FIG. 4 half of a longitudinal cross-sectional view of a drive wheel with a connecting piece or a bracket and inserts inserted into the connecting piece or the bracket.
Figure 5:
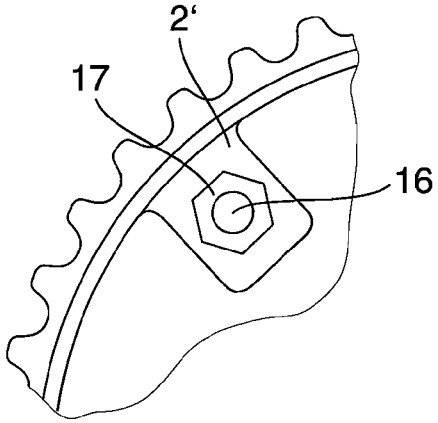
FIG. 5 a partial cross-sectional view of a drive gearwheel with radially inwards directed brackets and inserts arranged therein.

FIG. 2 shows a camshaft adjuster 1' in longitudinal section. In this camshaft adjuster, the drive wheel 2' is formed integrally with inwardly projecting, axial, approximately centrally arranged brackets 13, which extend in the direction of a longitudinal axis X-X of the camshaft adjuster 1' by one-third up to one-fourth of the width of the running teeth of the drive wheel 2' and which are distributed arbitrarily or equally over the periphery, cf. FIG. 3. A flange 14, which is formed integrally with the external rotor 3', contacts one end of the bracket 13. The brackets 13 and 14 are connected to each other with a friction, positive, and/or firmly bonded material fit and/or by means of attachment elements 15, which are formed as screws according to FIG. 2. Here, the brackets 13 and also the flange 14 have suitable bores 16 with or without threads. The bores 16 with or without threads can here be formed directly in the material forming the drive wheel or can be provided according to FIG. 4 by reinforcement intermediate layers 17, especially inserts, for example, made from metal, which are attached preferably with a positive fit to the additional integral elements of the drive wheel 2.

With reference to the drive wheel 2, the external rotor 3, the bearing surface 4, the internal rotor 6, the bearing surface 7, the projections 8, the insert body 11, the carrier body 12, the brackets 13, and/or the flange 14 there are the following shaping possibilities:

- The previously mentioned component can be made from any plastic or from a fiber composite material. In particular, a thermoplastic or a duroplastic of any composition can be used.
- Furthermore, any composite can be used, for example, a plastic with an iron metal or a non-iron metal. In terms of the coefficient of thermal expansion, these can be adapted to each other, so that, for example, plastic, fiber composite materials, or composite materials have equal coefficients of thermal expansion, such as adjacent components made from different materials. In particular, components arranged on the driven side, that is, components connected rigidly to the camshaft, have a greater coefficient of thermal expansion than components arranged on the drive side.
- The previously mentioned components can be assembled to form one or two-piece units. For example, the drive wheel 2, the external rotor 3, the bearing surface 4 with insert body 11, brackets 13, and carrier body 12, as well as flange 14 are constructed as an integral, installation space-optimized component made from one or more materials or composite materials.
- For lowering the weight and for improving the assembly possibilities, pockets can be provided in the previously mentioned components.
- Drive wheel 2 and insert body 11 can be connected to each other, possibly under the intermediate connection of additional (sub) bodies with a non-positive fit, for example, by screws, with a positive fit, for example, by rivets, or with a firmly bonded material fit, for example, by bonding, injection molding, or one-piece production, wherein combinations of the previously mentioned connection possibilities are also conceivable.
- Non-plastic elements can be used as auxiliary agents for screw connections, for example, on the basis of a "mold-in" or "after-molding" technique. One "mold-in" technique involves, for example, a metal bushing with threads, which is molded in a die, while as an example for an "after-mold" technique, a metal bushing with threads is conceivable, which is inserted into a plastic part after the molding process.
- Metallic elements or sub-parts can be formed as reinforcement material in other material, for example, for homogenizing the expansion and/or for reinforcing, for forming support material, and for increasing the component stiffness.
- A selection of the materials and their orientation can be used as thermal construction parameters, in which a desired target size is set according to the element and its volume percentage of the coefficient of expansion.
- The use of reinforcement intermediate layers or inserts can be used especially for minimizing setting force losses and for permitting direct screw connection.
- According to FIG. 1, the external rotor can be embedded directly in a plastic material. This plastic material can be joined with the external rotor directly, for example, in an injection molding process or else by means of later mounting.

Figure 6:
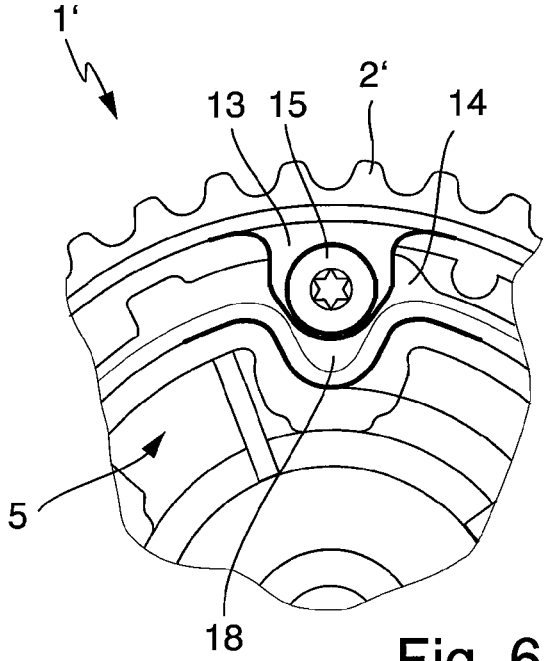
FIG. 6 a partial cross-sectional view of camshaft adjuster according to the invention, wherein attachment elements are pulled radially inwards, so that their distance from the longitudinal axis of the camshaft adjuster is smaller than the outer diameter of the pressure chambers, and FIG. 7 a view of a drive gearwheel made from plastic, which is attached by means of a carrier to a housing of the camshaft adjuster.

FIG. 6 shows a partial cross section allocated to the embodiment according to FIG. 2. From this it is visible that the flange 14 has no circular outer contours, but instead projects radially outwards in the attachment region to the brackets 13. It is to be seen further that the external rotor 3 has sub-areas with the pressure chambers 5, which project radially outwards and the attachment elements 15 are connected in the area of recesses 18 or radially inwards oriented pockets with the external rotor 3. In this way, the attachment elements 15 can be "pulled down" to form small radii, so that the attachment elements 15 act at a radius that lies in the area of the outer diameter of the pressure chamber 5 or is less than this area. Here, the attachment elements 15, the brackets 13, and any flange 14 are provided axially between the end faces of the drive wheel 2', so that a small axial installation size is produced.

Figure 7:
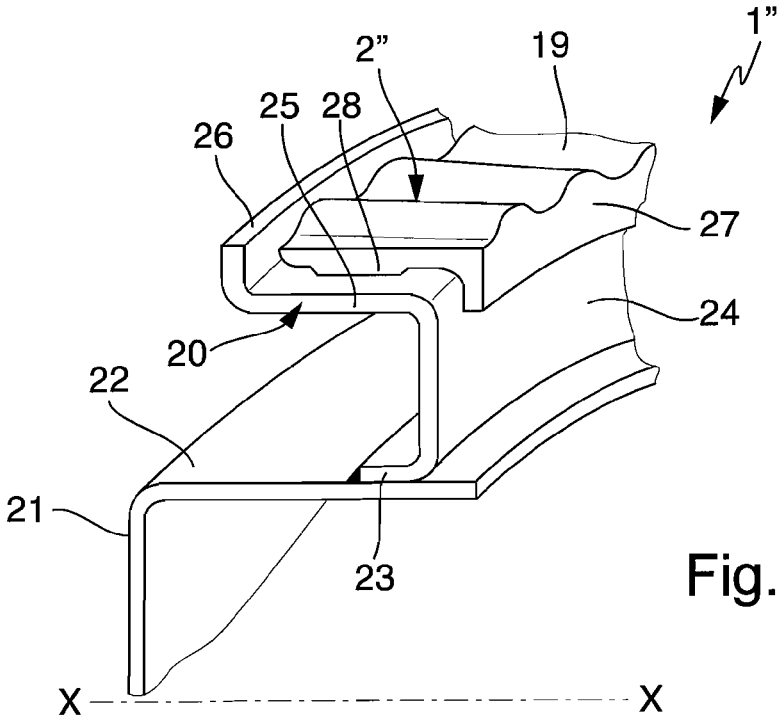

FIG. 7 shows an example construction for a drive wheel 2" with associated components, here a toothed ring 19, a carrier 20, and a housing 21.

The housing 21 is formed especially as a sheet part with an approximately cylindrical casing surface 22 and includes additional components of the camshaft adjuster 1". The carrier 20 is rigidly supported on the casing surface 22, especially by a positive-fit connection. Here, the carrier 20 has a hollow cylindrical contact connecting piece 23, which contacts the casing surface 22 on the inside radially and is connected with a positive fit on at least one axial end face with housing 21. The contact connecting piece 23 transitions, especially under an intermediate connection of a transmission radius, into a circular ring plate-shaped carrier body 24, which is oriented coaxially relative to the longitudinal axis X-X and which in turn transitions into a hollow cylindrical outer body 25 with a projection 26 or collar running in the end area opposite the carrier body 24.

The toothed ring 19 contacts the projection 26 in the area of an axial end face, while the opposite end of the toothed ring 19 has a radially inwards projecting projection 27, which contacts the carrier body 24 or the transition region between the carrier body 24 and the outer body 25. On the inside radially, especially approximately centrally, the toothed ring 19 has a connecting area 28 extending around or provided across partial extents of the periphery, which extends approximately over half the width of the toothed ring 19. The connecting area 28 is connected to the outer casing surface of the outer body 25 with a positive, friction, or firmly bonded material fit.

All of the previously mentioned materials or material combinations can be used for the toothed ring 19, the carrier 20, and the housing 21. As an exemplary embodiment, a production of the toothed ring 19 from plastic, especially a duroplastic, is conceivable, while the carrier 20 and the housing 21 are produced from a metal.

LIST OF REFERENCE SYMBOLS

1 Camshaft adjuster
2 Drive wheel
3 External rotor
4 Bearing surface of external rotor
5 Pressure chamber
6 Internal rotor
7 Bearing surface of internal rotor
8 Projections
9 Pressure space
10 Pressure space
11 Insert body
12 Carrier body
13 Bracket
14 Flange
15 Attachment element
16 Bore
17 Reinforcement insert
18 Recess
19 Toothed ring
20 Carrier
21 Housing
22 Casing surface
23 Contact connecting piece
24 Carrier body
25 Outer body
26 Projection
27 Collar
28 Connecting area

The invention claimed is:

1. Camshaft adjuster for an internal combustion engine, comprising a drive wheel and a driven element in which a relative angular relationship between the drive wheel and the driven element, which is allocated to a camshaft, can be adjusted by hydraulic charging of pressure spaces between an external rotor and an internal rotor, the drive wheel is produced with plastic and the external rotor allocated to the drive wheel is produced with metal, at least one bearing surface of the external rotor is formed with a metallic insert body, which is held with a firmly bonded material fit or positive fit in a carrier body made from plastic.

2. Camshaft adjuster according to claim 1, wherein the insert body is formed so that it extends in a peripheral direction and also forms a limit for the pressure spaces in addition to the bearing surface.

3. Camshaft adjuster according to claim 1, wherein the external rotor and/or the carrier body have connection elements.

4. Camshaft adjuster according to claim 1, wherein the drive wheel is produced from a composite material or fiber composite material.

5. Camshaft adjuster according to claim 1, wherein the internal rotor is formed with plastic and has the at least one bearing surface made from metal connected with a positive or firmly bonded material fit to the internal rotor.

6. Camshaft adjuster according to claim 1, wherein insert bodies and carrier bodies are connected to each other with firmly bonded material by an injection molding process.

7. Camshaft adjuster for an internal combustion engine, comprising a drive wheel and a driven element in which a relative angular relationship between the drive wheel and the driven element, which is allocated to a camshaft, can be adjusted by hydraulic charging of pressure spaces between an external rotor and an internal rotor, the drive wheel is produced with plastic and the external rotor allocated to the drive wheel is produced with metal, at least one bearing surface of the external rotor is formed with a metallic insert body, which is held with a firmly bonded material fit or positive fit in a carrier body made from plastic, and the drive wheel is formed with a toothed ring, belt wheel, or chain wheel made from plastic and is connected via attachment elements to a flange made from plastic, which is attached to the insert body with a positive fit.

8. Camshaft adjuster according to claim 7, wherein the attachment elements interact with reinforcement inserts of the toothed ring and/or the flange.

9. Camshaft adjuster according to claim 7, wherein the connection between the flange and toothed ring is provided radially on an inside of the toothed ring.

10. Camshaft adjuster according to claim 7, wherein the attachment elements act at a radius that is smaller than an outer diameter of the pressure chamber.

* * * * *